US006572486B2

(12) United States Patent
Sweinhart

(10) Patent No.: US 6,572,486 B2
(45) Date of Patent: Jun. 3, 2003

(54) PUTTER PRACTICE APPARATUS

(76) Inventor: Mike Sweinhart, 815 Plantation Ridge Overlook, Woodstock, GA (US) 30188

( * ) Notice: Subject to any disclaimer, the term of this patent is extended or adjusted under 35 U.S.C. 154(b) by 0 days.

(21) Appl. No.: 09/781,214

(22) Filed: Feb. 13, 2001

(65) Prior Publication Data

US 2002/0111224 A1 Aug. 15, 2002

(51) Int. Cl.[7] ..... A63B 69/36
(52) U.S. Cl. ..... 473/257; 473/267
(58) Field of Search ..... 473/257, 258, 473/259, 267, 229, 260, 273; 273/191 R, 191 A, 191 B, 192

(56) References Cited

U.S. PATENT DOCUMENTS 3,806,133 A * 4/1974 Cork ..... 473/258
4,053,160 A * 10/1977 Salata ..... 473/240
4,900,030 A 2/1990 Houtz
4,928,975 A * 5/1990 Skelley et al. ..... 473/264
4,998,731 A * 3/1991 Bowen ..... 473/271
5,586,945 A * 12/1996 Vonderhaar ..... 473/258
5,769,732 A * 6/1998 O'Neil ..... 473/258
5,776,007 A 7/1998 Kendall et al.
5,954,600 A * 9/1999 Gill ..... 473/478
5,997,410 A 12/1999 Nothdurft

* cited by examiner

*Primary Examiner*—Paul T. Sewell
*Assistant Examiner*—M. Chambers
(74) *Attorney, Agent, or Firm*—Lawrence Carnes

(57) ABSTRACT

The present invention is a golf putter practice apparatus designed and configured to aid and improve a golfer's putting capabilities through repetitious use. The present invention is a frame structure having a lower portion and an upper portion. The lower portion will be located on the desired surface for putting and the upper portion will be elevated from this lower portion. The lower portion acts as a supports and supports the upper portion which includes a horizontal bar member. This horizontal bar member acts as a guide. Thus for utilization, the user places a golf ball in front of the horizontal bar member. The club's head is placed behind the ball and the shaft will rest against the horizontal bar. This will force the shaft to move in a straight and forward position thus improving on the golfer's swing and putting capabilities.

12 Claims, 3 Drawing Sheets

PUTTER PRACTICE APPARATUS

BACKGROUND OF THE INVENTION

1. Field of the Invention

The present invention relates generally to a putter practice apparatus and more particularly to a portable putter practice apparatus that is designed and configured to avert a putter from veering to the left or right, thereby enforcing a linear motion or straight swing close to the putting surface with an emphasis on accurate foot placement, this will innately improve on one's putting in the field of golf.

2. Description of the Prior Art

In the sport of golf, putting is an area of particular weakness for many golfers. At least half of the total score during a round of golf is accounted for by putting strokes. It is well known that a golfer can achieve a rather suitable score if putting is accurate in the event of numerous erratic tees and fairway shots. When putting, the golfer must deliver a precisely balanced and directional stroke to make the hole. In order to improve on the skill of putting, golfers have tried numerous types of golfing equipment with specific concentration on putting. As such, numerous prior attempts have been made to develop golfing equipment with particular concentration on putting.

For example, U.S. Pat. No. 4,900,030 issued to Houtz discloses a collapsible putting stroke training device for improving putting strokes which includes a guide member spaced from the ground for sliding contact with the back side of a putter shaft.

Yet another example is seen in U.S. Pat. No. 5,997,410 issued to Nothdurft wherein disclosed is an improvement in a golf training device which provides a foot mat for the golfer to stand on thereby enabling his weight to steady the position of the guide bar during use of the golf training device.

Another example is seen in U.S. Pat. No. 5,776,007 issued to Kendall et al wherein disclosed is a putting practice device and a method for improving the putting of a golf ball. The putting practice device provides a sighting member and a shaft guide to assist in aligning and stroking a golf putt. The method addresses finding and verifying a sight line that extends from a golf ball to a desired target.

Though these patents as described above, have proven to be successful in putting practice, they address complex bulky devices which may be difficult to assemble as well as difficult to utilize. What is needed is a putter practice apparatus that is portable and compact in size so as to be easily stored in a carrying case. Such a device should be efficient and substantially traditional in appearance so as to provide for a final product that is simple in design and structure and which will prove successful in achieving the desired results.

Hence it is seen that none of these previous inventions provide the benefits intended with the present invention, such as providing a compact and portable putting practice apparatus. Additionally, prior techniques do not suggest the present inventive combination of component elements as disclosed and claimed herein. The present invention achieves its intended purposes, objectives and advantages over the prior art devices through a new, useful and unobvious combination of component elements, which is simple to use, with the utilization of a minimum number of functioning parts, at a reasonable cost to manufacture, assemble, test and by employing only readily available material.

SUMMARY OF THE INVENTION

The present invention relates to a means of improving the putting capabilities of a golfer by providing a product that will produce linear motion so as to guide the golfer's swing. The present invention can be utilized as a putter practice device when desired yet can also be used as a means for practicing chip shots.

Assembled, the present invention can be used on any flat surface, such as, but not limited to carpet, concrete, grass, putting green or the like. In addition, this product is designed and configured to be portable as well as simple in structure so as to provide for a final product that is not only compact but enables an efficient means of practicing putting when desired. When the present invention is not in use, it can be collapsed and/or disassembled, and placed in a bag, carrying case or the like for adequate storage.

To enable efficient putting practice, the present invention comprises a frame structure having a lower portion and an upper elevated portion extending upwardly and outwardly therefrom. For stability, the lower portion is provided. This lower portion comprises a first horizontal bar having arms extending outwardly from its outer ends. This structure inherently forms a U-shape member, wherein the opening of the U-shape portion will provide an area upon which a golfer can stand while putting.

Extending upwardly from the outer ends are support brackets. Removably secured to the support brackets, in an elevated position, is a second horizontal bar member or guide bar. This second horizontal bar member is parallel with the first bar member and is designed to move and possibly dislodge from the support brackets should the golfer place too much force thereon. Thus, this second horizontal bar is known as the horizontal breakaway guide bar.

In use, the golfer stands in proximity to the first horizontal bar, so that their feet are located within the arms. The golf ball is placed in front so as to provide for the ball to be located in front of the horizontal breakaway guide. Placing the head of the putter behind the ball will force the shaft to be located on the horizontal breakaway guide bar. Thus, the guide bar forces the golfer to swing smoothly, in a straight line and control fashion so as to enable correct form and efficient putting strokes. To enable adequate form, the guide bar is designed so that the distance of the second horizontal bar to the putting surface is close to the ground in order to force the golfer to keep the shaft of his putter close and the head of the putter horizontal to the putting surface.

Through repetitious use of the present invention, the golfer's muscles will be tuned to swing in a linear motion so as to provide for the golfer to swing in a straight line as well as force the golfer to maintain proper stance by rendering the feet placement to be in proximity to each other during putting. In time, the user will develop correct form and thus will reduce dependency on the breakaway elongated horizontal bar and ensuring correct putting strokes.

Various features can be added to the present invention for enhancing and increasing its usability. One element that can be added is a mirror that can be removable secured to a support bracket. This mirror can be designed to be removably secured as well as pivotally attached so as to allow for angular viewing adjustments to be made. The purpose of the mirror is to allow the golfer to check his alignment for the putting and thus will force the golfer to place his head and eyes directly over the golf ball during the act of putting.

Therefore, the present invention is designed so that the golfer improves on his putting while not becoming dependent on the device. Consequently, the present invention will ensure a well-balanced and linear directional stroke, by forcing the golfer to swing smoothly, in a control fashion, and most importantly, in a straight line.

Accordingly, it is the object of the present invention to provide for a putting practice apparatus which will overcome the deficiencies, shortcomings, and drawbacks of the prior putting practice apparatus and methods thereof.

Still another object of the present invention is to provide for a putter practice apparatus which, during repetitious use, will innately tune the muscles of the golfer so as to enable the golfer to swing in a straight line.

A further object of the present invention is to provide for a putter practice apparatus, that through repetitious use, will force the golfer to putt horizontally and close to the putting surface.

Still a further object of the present invention, to be specifically enumerated herein, is to provide a portable putter practice apparatus that can be stored in a carrying bag which can also hold shoes and other golf accessories, can be easily assembled and disassembled in accordance with the preceding objects and which will conform to conventional forms of manufacture, be of simple construction and easy to use so as to provide a device that would be economically feasible, long lasting and relatively trouble free in operation.

Although there have been many golf putting devices, none of these inventions have become sufficiently compact, low cost, and reliable enough to become commonly used. The present invention meets the requirements of the simplified design, compact size, low initial cost, low operating cost, ease of installation and maintainability, and minimal amount of training to successfully employ the invention.

The foregoing has outlined some of the more pertinent objects of the invention. These objects should be construed to be merely illustrative of some of the more prominent features and application of the intended invention. Many other beneficial results can be obtained by applying the disclosed invention in a different manner or modifying the invention within the scope of the disclosure. Accordingly, a fuller understanding of the invention may be had by referring to the detailed description of the preferred embodiments in addition to the scope of the invention defined by the claims taken in conjunction with the accompanying drawings.

BRIEF DESCRIPTION OF THE DRAWING

Similar reference numerals refer to similar parts throughout the several views of the drawings.

DESCRIPTION OF THE PREFERRED EMBODIMENT

Figure 1:
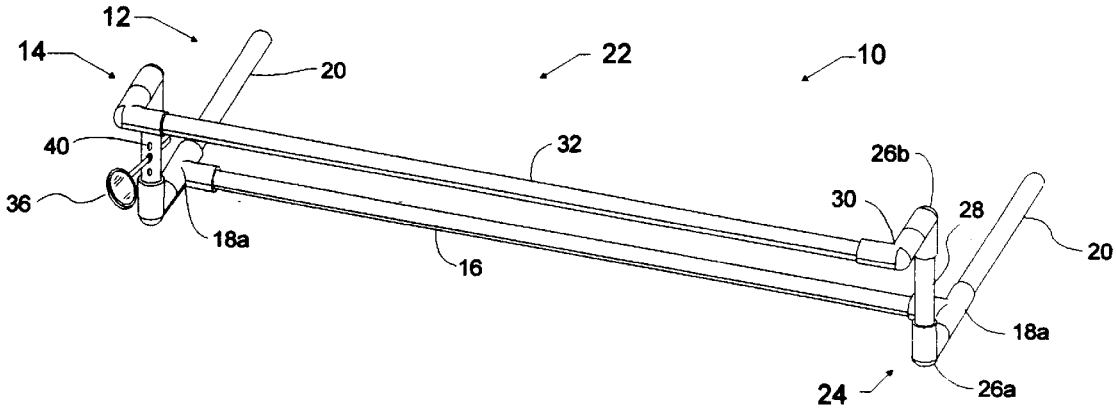
FIG. 1 is a perspective view of the putter practice apparatus of the present invention.

As seen in the drawings, in particular to FIGS. 1–4, there is shown a putter practice apparatus, denoted by reference numeral 10, that is designed and configured to enforce a straight swing which does not veer to the left or right and maintains close proximity to the putting surface with an emphasis on accurate foot placement. Assembled, the present invention can be used on any flat surface, such as, but not limited to carpet, concrete, putting green or the like. In addition, this product is designed and configured to be portable as well as simple in structure so as to provide for a final product that is not only compact but enables an efficient means of practicing putting when desired. When the present invention is not in use, it can be collapsed and/or disassembled, and placed in a bag, carrying case or the like for adequate storage As seen in FIGS. 1–4, the portable putting practice apparatus of the present invention 10 comprises a frame structure having a lower portion 12 and an upper elevated portion 14 extending upwardly and outwardly therefrom. This lower portion 12 will be located on the ground/floor during use and thus will rest on the same surface as the golf ball. Due to this, the lower portion 12 will provide stability for the present invention 10.

To provide for stability, the lower portion 12 comprises a first horizontal bar 16. Coupled to the outer ends of the horizontal bar 16 are arms 18*a* and 18*b*. These arms are conventional T-shape couplings and thus provide for the arms to extend perpendicular in both frontward and rearward position from the horizontal bar 16. Removably secured to the arms, in the rearward position, are support members 20. The support members 20 are slideably secured within the arms 18*a* and 18*b*.

Hence, arms 18*a* and 18*b* are hollow tubular members that that will receive the support members 20. Thereby, providing for the support member to be slideably located within the arms. This will inherently provide for a snug and secure fit between the arms and support member. This slidable securement by the use of the T-shape coupling is conventional.

The arms, horizontal bar and support members form a lower portion having a U-shape structure. The gap or opening 22 formed by the support members will provide an area upon which a golfer can stand while utilizing the present invention when practicing putting. Ideally, feet placements are centrally located and in close proximity to the first horizontally bar member 16 (as shown via dashed outline in FIG. 2).

Coupled to arms 18*a* and 18*b* in the frontward position, are support brackets 24. Removably secured to the support bracket is a second, elevated horizontal bar member 32. As seen, the support bracket renders the horizontal bar member 32 to be elevated. To permit for this configuration, each support bracket 24 comprises a first elbow 26*a* coupled to the frontward position of the T-shape coupling 18. A shaft 28 is secured to the first elbow and extends upwardly from the support members. Thereby providing for the first elbow to be secured to the first end of the shaft 28. Secured to the second end of the shaft 28 is a second elbow 26*b*. Mating the second horizontal bar member 32 to the second elbow 26*b* is a third elbow 30. This third elbow is need not be permanently secured to the second horizontal bar.

When assembled, the second horizontal bar member is parallel with the first bar member and is designed to move and possibly dislodge from the third elbow, should the golfer place too much force thereon. Thus, this second horizontal bar is known as the horizontal breakaway guide bar.

Figure 2:
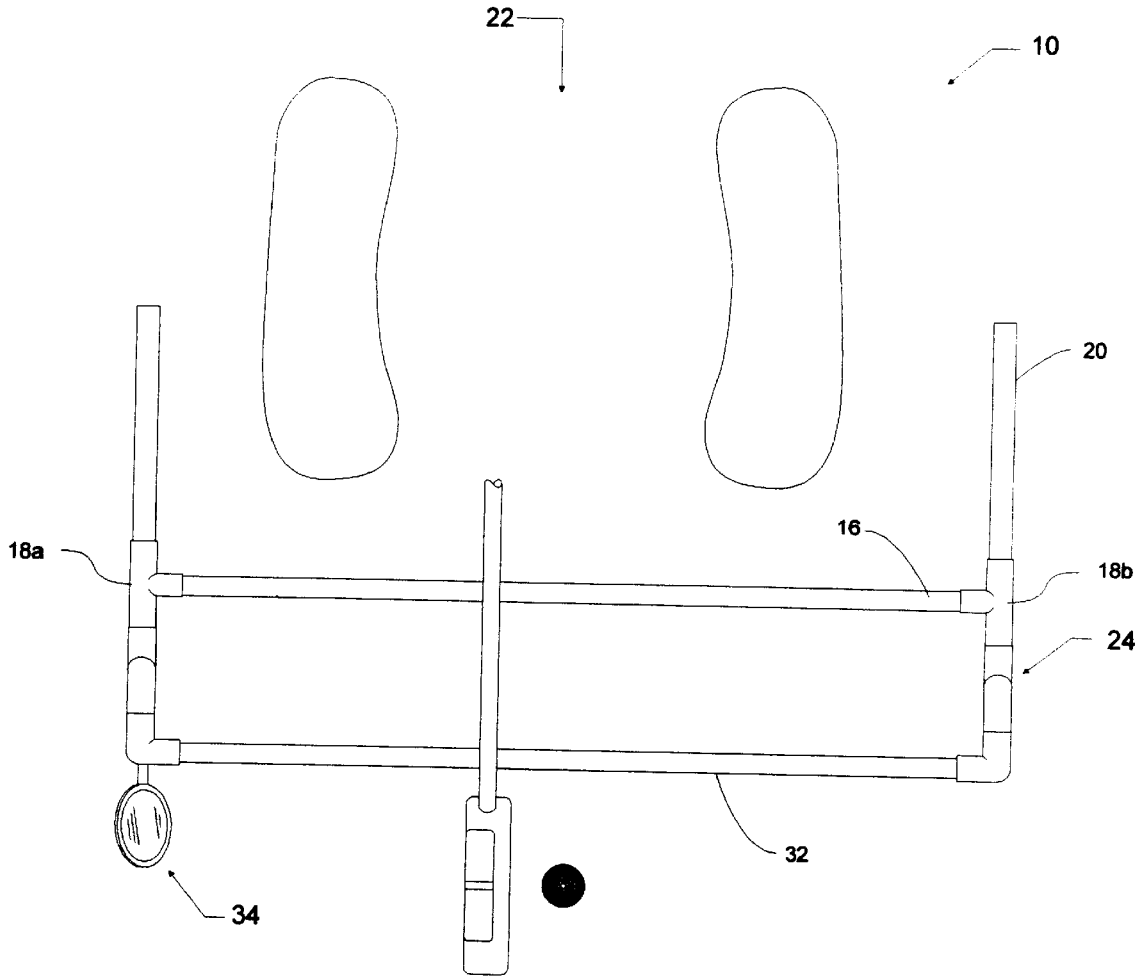
FIG. 2 is a top view of the putter practice apparatus of the present invention.

In use, the golfer places his feet centrally within the gap 22 formed between the two supports 20, as seen in FIG. 2, and in proximity to the first horizontal bar member 16. Once in the proper stance, the golfer then places his ball in front of the first horizontal bar and in front of the second horizontal bar (see FIGS. 2–4). Placing the head of the putter behind the ball, forces the shaft to be located on the horizontal breakaway guide bar (see FIGS. 3 and 4). Thus, the guide bar forces the golfer to swing smoothly, in a straight line and control fashion so as to enable correct form and efficient putting strokes. To enable adequate form, the guide bar is designed so that the distance of the second horizontal bar to the putting surface is close to the ground in order to force the golfer to keep the shaft of his putter close and the head of the putter horizontal to the putting surface.

Should too much force be applied, the shaft will abut the second horizontal bar abruptly, forcing the assembly to move. This will signify to the golfer that concentration and correct swing is required.

Through repetitious use of the present invention, the golfer's muscles will be tuned to swing in a straight line as well as force the golfer to maintain proper stance by rendering the feet placement to be in proximity to each other during putting. In time, the user will develop correct form and thus will reduce dependency on the breakaway elongated horizontal bar and ensuring correct putting strokes.

Various features can be added to the present invention for enhancing and increasing its usability. One element that can be added is a mirror assembly 34 that can be added to a support bracket 24. This mirror assembly can be designed to be removably secured via conventional attaching devices as well as be pivotally attached so as to allow for angular viewing adjustments to be made.

Figure 3:
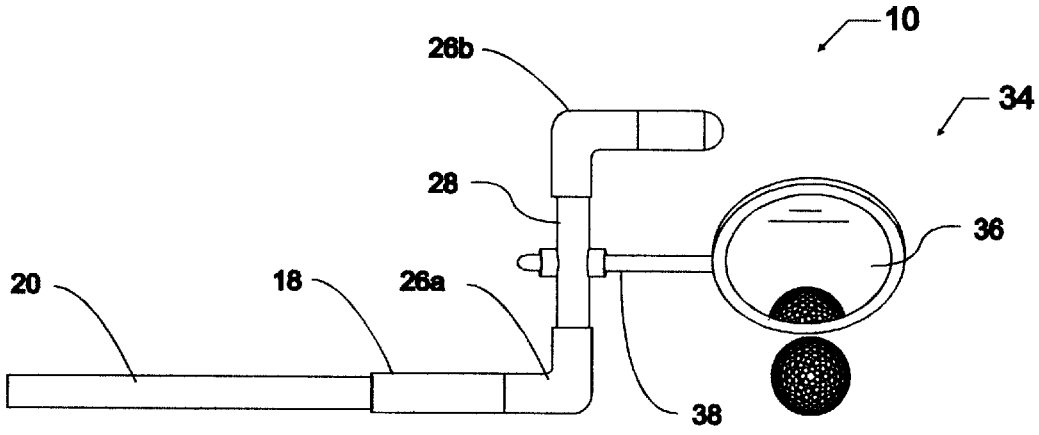
FIG. 3 is a side view of the putter practice apparatus of the present invention illustrating the front view of the mirror assembly used with the putter practice apparatus of the present invention.
Figure 4:
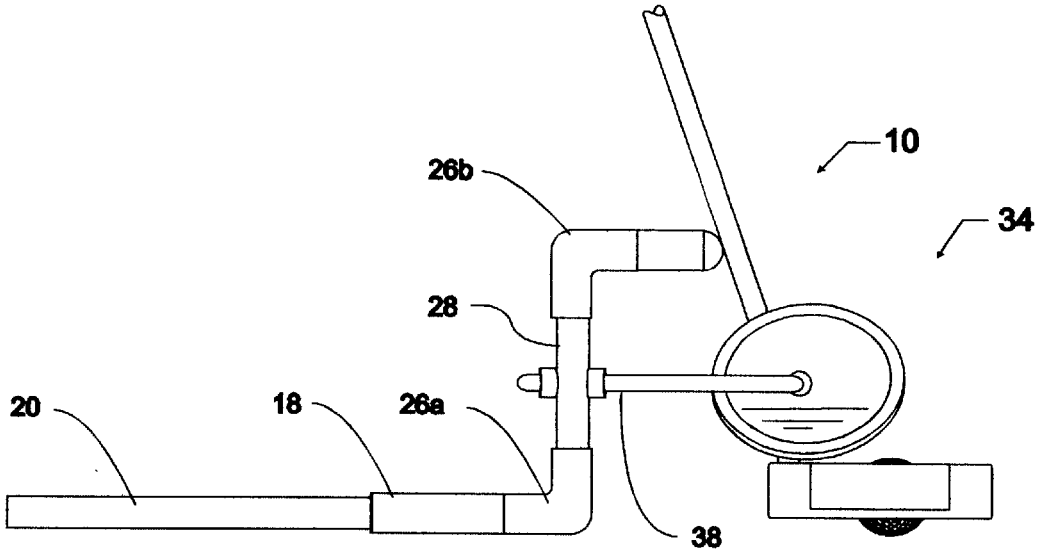
FIG. 4 is a side view of the putter practice apparatus of the present invention illustrating the rear view of the mirror assembly used with the putter practice apparatus of the present invention.

As seen in FIGS. 1–4, the mirror assembly 34 is conventional and comprises a reflective member (mirror) 36 pivotally secured to a shaft 38. The pivotal attachment is accomplished via universal and conventional joints that enable the mirror to be adjusted as desired. This shaft 38 is removably secured to the support bracket 24. As seen in the figures, at least one of the shafts of the support members includes at least one opening. The shaft of the mirror assembly is then inserted into the opening to provide for the openings to be removably secured thereto. As seen in FIGS. 3 and 4, the secured to the front and rear of each opening are hollow spacers (illustrated, but not labeled). The spacers increase the surface area of support and thus provide for the mirror assembly to be properly supported therein. In addition, the spacers may provide for a more secure attachment by providing for the shaft of the mirror assembly to be frictionally maintained therein.

Alternatively, this mirror can be permanently attached to the shaft of the support member 24. In this configuration, the shaft of the mirror assembly would be permanently secured to the spacers as defined above.

The purpose of the mirror is to allow the golfer to check his alignment for putting and thus will force the golfer to place his head and eyes directly over the golf ball during the act of putting. In this design, the golfer should be able to see the ball's reflection in the mirror. If the ball is viewed via the mirror, then correct posture and stance is accomplished.

The present invention is designed so that the golfer improves on his putting while not becoming dependent on the device. In order to achieve desired putting results, the putting practice apparatus of the present invention is designed to guide a putter along a straight path such that the arms of the golfer and the putter move with a natural straight motion close to the ground. This will consequently improve the golfer's putting stroke through repetitive training.

The present invention is versatile and can be used not only for practicing putting, but can also be used to practice chip shots. In this configuration, the golfer can place the apparatus in a grassy area, and practice commences as discussed above.

It is noted that invention can be easily disassembled so as to provide for a device that can be easily stored and one that can quickly be assembled if desired. For ease, the T-shape coupling can be permanently secured to the first horizontal member and the support brackets. The first and second elbow can be permanently secured to the shaft, support member and third elbow. The third elbow need not be permanently secured so as to enable the second horizontal bar to move and/or dislodge therefrom when too much force is applied. The permanent attachment of the third elbow is optional. Thus to store, the user would merely removes members 20 and to assemble, the user replaces member 20. A conventional elongated bag can be utilized for storing the present invention. Ultimately, the present invention is a device that is useful, compact and renders successful results.

While the invention has been particularly shown and described with reference to an embodiment thereof, it will be understood by those skilled in the art that various changes in form and detail may be made without departing from the spirit and scope of the invention.

I claim:

1. A putting apparatus comprising:

a main frame having an upper portion and a lower portion;

said lower portion for contacting a surface for putting and comprising a first horizontal bar having outer ends, and support members secured to said outer ends and extending rearwardly therefrom;

brackets coupled to said outer ends of said first horizontal bar and extending upwardly and frontwardly therefrom;

a second horizontal bar removably coupled to said brackets such that the second horizontal bar may be dislodged when struck by a golf putter in use, said second horizontal bar parallel to and elevated from said first horizontal bar such that said second horizontal bar acts as a guide for putting; and wherein said support members are removably secured to said outer ends of said first horizontal bar such that the apparatus may be stored and carried in an elongated bag without further disassembly.

2. A putting apparatus as in claim 1 further comprising a mirror assembly secured to the main frame and oriented to reflect an image of a ball placed in front of the second horizontal rod to a user's eyes positioned directly above the ball.

3. A putting apparatus as in claim 2 wherein the mirror assembly is removably secured to one of said brackets.

4. A putting apparatus as in claim 2 wherein said mirror assembly includes a reflective member that is secured to a shaft and said reflective member is pivotally secured to said shaft for enabling angular adjustments.

5. A putting apparatus as in claim 3 wherein said mirror assembly includes a reflective member that is secured to a shaft and said reflective member is pivotally secured to said shaft for enabling angular adjustments.

6. A putting apparatus as in claim 2 wherein spacers are located frontwardly and rearwardly with respect to said bracket and is used for supporting said mirror assembly.

7. A putting apparatus as in claim 3 wherein said bracket includes at least one aperture and said aperture removably receives said mirror assembly.

8. A putting apparatus as in claim 7 wherein spacers are located frontwardly and rearwardly with respect to each of said apertures for supporting said mirror assembly.

9. A putting apparatus comprising a main frame having an upper portion and a lower portion;

said lower portion for contacting a surface for putting and comprising:

a first horizontal bar having outer ends and support members secured to said outer ends and extending rearwardly therefrom;

brackets coupled to said outer ends of said first horizontal bar and extend upwardly and frontwardly therefrom;

a second horizontal bar coupled to said brackets and said second horizontal bar parallel to and elevated from said first horizontal bar to act as a guide for putting; and a mirror assembly secured to the main frame and oriented to reflect an image of a ball placed in front of the second horizontal rod to a user's eyes positioned directly above the ball.

10. A putting apparatus as in claim 9 wherein the mirror assembly is secured to at least one of said brackets.

11. A putting apparatus as in claim 9 wherein the mirror assembly is removably secured to at least one of said brackets.

12. A putting apparatus as in claim 9 wherein said second horizontal bar is adapted to move when struck by a putter.

* * * * *